United States Patent [19]

Wright

[11] Patent Number: 4,638,503

[45] Date of Patent: Jan. 20, 1987

[54] FULLY COMPATIBLE AM STEREOPHONIC TRANSMITTING SYSTEM

[75] Inventor: Charles S. Wright, Springfield, Va.

[73] Assignee: Delta Electronics, Alexandria, Va.

[21] Appl. No.: 703,681

[22] Filed: Feb. 20, 1985

[51] Int. Cl.[4] ..... H04H 5/00

[52] U.S. Cl. ..... 381/16; 332/17; 332/18; 332/21; 332/23 A; 332/37 D; 332/40

[58] Field of Search ..... 381/2, 15, 16; 455/61, 455/126; 332/17, 18, 21, 22, 23 A, 37 D, 40

[56] References Cited

U.S. PATENT DOCUMENTS

| | | | |
|---|---|---|---|
| 4,323,731 | 4/1982 | Hershberger | 332/21 |
| 4,338,491 | 7/1982 | Parker et al. | 381/16 |
| 4,373,115 | 2/1983 | Kahn | 381/16 |
| 4,520,498 | 5/1985 | Hershberger | 332/23 A |

*Primary Examiner*—Forester W. Isen
*Attorney, Agent, or Firm*—R. Lewis Gable

[57] ABSTRACT

A stereophonic transmitting system is disclosed for transmitting in quadrature a single carrier signal carrying first and second signals. The transmitting system comprises a phase shifter or modulator for phase shifting a carrier signal of a frequency fc in accordance with a feedback signal to provide a phase shifted carrier signal. A first detector operates to detect a component of the phase modulated carrier signal in phase with the carrier signal to provide an in-phase signal and a second detector to detect a component of the phase modulated carrier signal out-of-phase with the carrier signal to provide a quadrature signal. A first multiplier multiplies the in-phase signal by the first signal to provide a first multiplied signal and a second multiplier multiplies the quadrature signal by the second signal to provide a second multiplied signal. A difference circuit is provided for obtaining the difference between the first and second multiplied signals to provide the feedback signal to the phase shifter. A matrix provides a third signal indicative of the difference of the first and second signals and a fourth signal indicative of the sum of the first and second signals. A transmitter amplitude modulates the phase modulated carrier signal derived from the phase shifter in accordance with the third signal.

8 Claims, 7 Drawing Figures

FULLY COMPATIBLE AM STEREOPHONIC TRANSMITTING SYSTEM

BACKGROUND OF THE INVENTION

1. Field of the Invention

This invention relates to AM stereophonic transmitting systems for the transmission of at least two signals on a single carrier and, more particularly, to such improved systems for transmitting fully compatible AM stereophonic signals.

2. Description of the Prior Art

Interest in transmitting stereophonic information over the AM frequency band has existed for more than 50 years, nearly as long as commercial AM broadcasting, itself, has existed. During this time, many different schemes have been suggested for communicating the stereophonically-related audio signals from the broadcasting station to the radio receivers. None of these schemes, however, has met with general approval by the broadcasting community since none has demonstrated a clear superiority over the others.

A number of criteria is commonly used in comparing the performance of the various systems. Generally stated, these criteria include the quality of stereophonic reproduction in stereophonic receivers and the compatibility of the transmitted stereo signal for reception by currently available (monaural) AM receivers. In addition, it is desired that the stereophonic signals transmitted should not occupy any greater RF bandwidth than that presently allocated for monaural AM transmission.

More specifically, the stereophonic performance of an acceptable AM stereo system should be such that, upon reception, the signal-to-noise ratio is as great as possible. In any event, it should not be significantly degraded as compared to reception obtainable with current monaural systems. Also, the distortion introduced by the transmission and reception of the stereo signal should be minimal. Finally, the separation between the stereophonically related signals, usually referred to as the left signal (L) and the right signal (R), should be as great as possible.

With respect to monaural compatibility, any acceptable AM stereo system must be fully compatible with monaural receivers currently available on the market. In other words, the detection of the composite stereo signal with the monaural envelope detectors currently in use should produce a signal corresponding to the sum (L+R) of the two stereophonically related signals, without noticeable distortion. Additionally, the loss in the loudness of the received signal in monaural receivers due to the stereophonic nature of the broadcast signal should be as low as possible.

An AM stereophonic broadcast system, typical of the prior art, includes a transmitter station and a receiver station. The transmitter station illustratively includes two signal sources. For the broadcast of audio signals, the two signal sources provide the left signal (L) and the right signal (R). Such systems encode the left signal (L) and right signal (R) to form two new component signals (L+R) and (L−R). One of these component signals is applied to an amplitude modulator to modulate a carrier wave; the other component is used to phase (or frequency) modulate the carrier wave.

The receiving station receives the transmitted signal and supplies it to an RF front end for detection, amplification and conversion to an intermediate frequency IF signal. The IF signal is applied to a stereophonic decoder or demodulator to reconstruct the left and right source signals (L) and (R). The reconstructed left and right signals (L) and (R) are amplified and applied to respective speakers to reproduce the stereophonic sound.

One such stereophonic broadcast system is described in U.S. Pat. No. 4,218,586 of Parker et al. The Parker et al. broadcast system matrixes the left and right signals (L) and (R) to provide a first component signal (1+L+R) and a second component signal (L−R). The (L+R) component signal directly amplitude modulates the transmitted signal. The (L−R) component signal phase modulates the transmitted signal in a manner simulating a quadrature modulated signal. FIGS. 1A, 1B and 1C are vector diagrams illustrating the relationship of these modulation component signals. In these figures, the unmodulated carrier wave C is taken as a reference for both amplitude and phase. In FIG. 1A where the left signal (L) has been set equal to the right signal (R) as would occur for monaural program material, the (L+R) component signal adds to and subtracts from the carrier amplitude resulting in pure amplitude modulation; the (L−R) component signal is zero under this condition and the resultant vector I is always in phase with the carrier signal C. In FIG. 1B where the left signal (L) has been set equal to the negative of the right signal (R) to permit only quadrature modulation, the (L−R) component signal is added in quadrature with the carrier signal C producing a resultant wave (E), whose phase leads or lags the carrier signal C as the (L−R) component signal varies over its positive and negative excursions.

The instantaneous phase angle is labeled $\phi$ in these figures. FIG. 1C shows the general case in which the left signal (L) and right signal (R) have no special relationship. In FIG. 1C, both amplitude and phase modulation result. Normalizing to the carrier signal C, i.e., $C=1\ \angle\phi$, the instantaneous amplitude of the resultant wave (E) is expressed as:

$$E=\{(1+L+R)^2+(L-R)^2\}^{\frac{1}{2}} \tag{1}$$

and its instantaneous phase is expressed as:

$$\phi = \tan^{-1}\frac{(L-R)}{1+L+R} \tag{2}$$

In the Parker et al. broadcast system, the first encoded component (1+L+R) is applied to a first amplitude modulator to produce the signal as shown in FIG. 1A, and the second encoded component is applied to a second amplitude modulator. An RF exciter provides a first carrier signal to the first modulator and to a phase shifter, which applies a second carrier signal phase shifted by 90° with respect to the first carrier signal to the second modulator. The outputs of the first and second modulators are summed to provide a signal as shown in FIG. 1C. This signal may be represented mathematically as:

$$E\mathrm{Cos}(Wt+\phi), \tag{3}$$

where E is defined by equation (1) above. Parker recognized that a monaural receiver using a conventional envelope detector would detect the envelope portion or E of this signal in accordance with equation (3) and would produce an undistorted signal only when the left signal (L) equals the right signal (R). Parker et al. proposed to make his broadcasted signal compatible with normal monaural receivers by removing the amplitude portion E of the signal in accordance with equation (3) by a limiter, leaving only the phase portion. The resulting phase portion is amplitude modulated according to Parker et al. by a signal component (1+L+R) in a high level modulator. The transmitted signal may be represented by (1+L+R)Cos (wt+$\phi$), which is the equivalent of the output from the adder multipled by Cos $\phi$, where Cos $\phi$ equals:

$$(1 + L + R)/\sqrt{(1 + L + R)^2 + (L - R)^2} \quad (4)$$

The transmitted signal of Parker et al. is compatible when it is received by a monaural receiver incorporating an envelope detector. An envelope detector is oblivious of the phase component of the transmitted signal and will demodulate the transmitted signal to produce the component signal (1+L+R).

A receiver can decode the transmitted stereophonic signals by using a synchronous detector operating in phase with respect to the carrier signal C to demodulate the (1+L+R) component signal and a quadrature synchronous detector to demodulate the (L−R) component signal. Summing these component signals produces a left signal (L) and subtracting produces a right signal (R). The "1" term is a DC component which can be removed by capacitive coupling. Parker et al. disclose a stereophonic receiver, wherein the received signal is limited and, then, compared by a multiplier with the phase of the carrier signal Cos wt, which is locked to the phase of the RF exciter in the transmitter. The output of the multiplier Cos $\phi$ is applied to a corrector circuit along with the received signal, whereby a signal in the form of equation (3) is reproduced. The output of the corrector circuit is applied to a first multiplier acting as a synchronous detector, where it is multiplied by Cos $\phi$ and is shifted positively by 45°, and to a second multiplier acting as a synchronous detector, where it is multiplied by Cos $\phi$ and shifted negatively by 45°. The outputs of the first and second multipliers correspond respectively to the component signals (1+L+R) and (L−R). These component signals are in turn applied to a conventional matrix decoder, which provides the left signal (L) and right signal (R).

The most complex part of the Parker et al. stereophonic modulation procedure is the generation of the phase modulation $\phi$. It is the purpose of this invention to disclose an improved method and apparatus for generating this phase modulation component. As discussed above, Parker et al. employs a limiter to produce their phase modulation component, which is in turn applied as a carrier source for the standard AM transmitter. There are inherent difficulties in its precise implementation. First, the production of full stereophonic signal at radio frequency requires two modulation steps which must be in accurate magnitude and phase relationships. Second, a severe requirement is placed on the limiter used to remove the amplitude component. Limiting must be performed over a very wide dynamic range. Very careful design and adjustment of the limiter circuitry is required to minimize incidental phase shifts.

SUMMARY OF THE INVENTION

It is therefore an object of this invention to provide a new and improved AM stereophonic transmitting system, which is fully compatible with existing monaural receivers.

It is a more particular object of this invention to provide a new and improved stereophonic transmitting system capable of generating phase modulated carrier signals.

It is a still more specific object of this invention to provide a new and improved stereo phase modulator that avoids the difficulties of the prior art which arise from the need to use limiting circuitry and, more particularly, to provide such circuitry with improved long term stability.

These and other objects of this invention are accomplished in accordance with the teachings of this invention by providing a stereophonic transmitting system for transmitting in quadrature a single carrier signal carrying first and second signals. The transmitting system comprising a phase shifter or modulator for phase shifting a carrier signal of a frequency fc to provide a phase shifted carrier signal, a first detector for detecting a component of the phase modulated carrier signal in phase with the carrier signal to provide an in-phase signal and a second detector for detecting a component of the phase modulated carrier signal out of phase with the carrier signal to provide a quadrature signal, a first multiplier for multiplying the in-phase signal by the first signal to provide a first multiplied signal, and a second multiplier for multiplying the quadrature signal by the second signal to provide a second multiplied signal and a difference circuit for obtaining the difference between the first and second multiplied signals to provide a feedback signal to the phase shifter. A matrix provides a third signal indicative of the difference of the first and second signals and a fourth signal indicative of the sum of the first and second signals. A transmitter amplitude modulates the phase modulated carrier signal derived from the phase shifter in accordance with the third signal.

In a further aspect of this invention, the difference circuit has a gain sufficiently high so that the first and second multiplied signals are made substantially equal to each other. In an illustrative embodiment of this invention, the gain of the difference circuit is set to be not less than 1000.

DESCRIPTION OF THE DRAWINGS

While the specification concludes with claims particularly pointing out and distinctly claiming the subject matter of this invention, it is believed that the invention will be better understood from the following description taken in conjunction with the accompanying drawings, wherein:

DESCRIPTION OF THE PREFERRED EMBODIMENT

Figure 2:
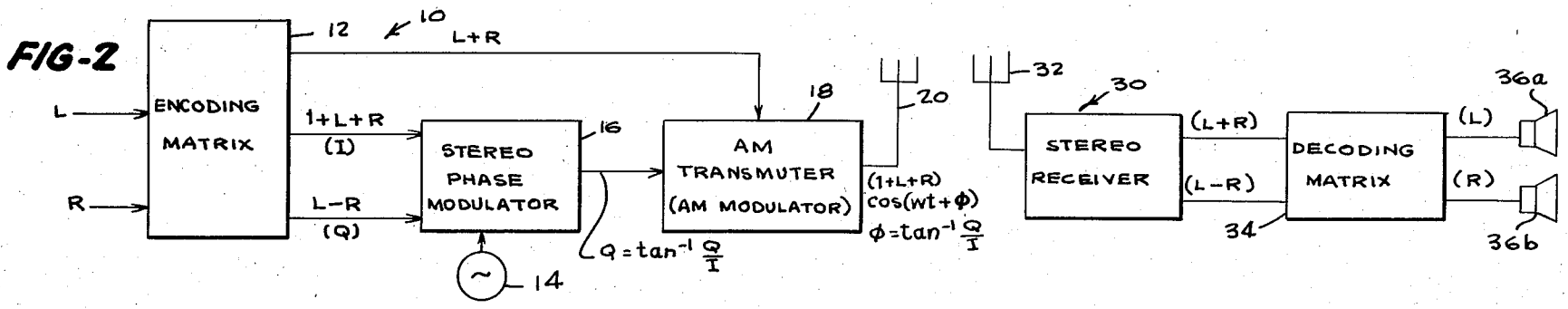
FIG. 2 is a block diagram of an AM stereophonic transmission system for generating and transmitting a fully compatible stereophonic AM signal in accordance of the teachings of this invention to a stereophonic receiving system.

Referring now to the drawings and in particular to FIG. 2, there is shown a block diagram of a complete AM stereophonic transmitting system 10 and an AM stereophonic receiving system 30. The AM stereophonic receiving system 30 may be any conventional stereophonic receiver. The transmitting system 10 generates a phase modulated signal Eo having a phase component Cos (Wct+$\phi$) and an envelope portion (1+L+R). The fully compatible signal Ec as transmitted by the transmitting system 10 is defined as:

$$Eo=(1+L+R)\ \mathrm{Cos}\ (Wct+\phi) \tag{5}$$

where

L=left source or channel signal as a function of time,

R=right source or channel signal as a function of time,

Wc=$2\pi$fc, carrier frequency in rad/sec, t=time, independent variable, and $$\phi = \tan^{-1}\frac{(L-R)}{(1+L+R)}$$

The left signal (L) and the right signal (R) are applied to an encoding matrix 12. The encoding matrix 12 employs straightforward use of operational amplifiers to combine the left signal (L) and right signal (R) as described above. Its details are obvious to one skilled in this art. The sum of these two signals (L+R) is used to modulate an AM transmitter 18. A direct current component is added to the L+R signal to produce the component signal (1+L+R). The magnitude of this component is chosen so that (1+L+R)=$\phi$ at 100% negative amplitude modulation. The component signal (L−R) is derived from the encoding matrix 12 by subtracting the right signal (R) from the left signal (L). The component signal component signal (1+L+R), hereafter called the I signal, and the (L−R), hereafter called the Q signal, are supplied to a stereo phase modulator 16. A carrier oscillator 14 drives the stereo phase modulator 16. The output of this modulator 16 is a constant magnitude carrier frequency signal phase modulated at the angle $\phi$ as expressed above by equation (2). The AM transmitter 18 (or other AM modulator) amplifies this carrier frequency signal to the desired power level, modulates it with the component signal (L+R) from the encoding matrix 12 and supplies it to an antenna system 20.

The signal transmitted from the antenna system 20 as defined by equation (5) above is fully compatible in that it may be received by the stereo receiver 30, as identified above, to reproduce the component signals (L+R) and (L−R), which are in turn applied to a decoding matrix 34 to provide the left signal (L) and the right signal (R) as commonly employed to drive speakers 36*a* and 36*b* to reproduce stereophonic sound. The transmitted signal is also compatible with commonly available monaural receivers typically employing envelope detectors to recover the (L+R) or monaural signal. The transmitted signal is received and reporduced without substantial distortion to provide monaural or stereophonic sound.

Figure 3:
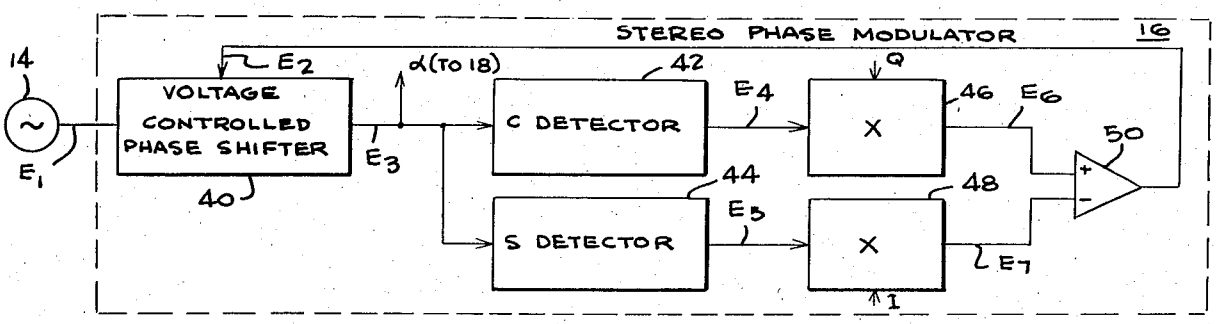
FIG. 3 is a functional block diagram of the stereo phase modulator as may be incorporated into the AM stereophonic transmission system of FIG. 2.

FIG. 3 shows the details of one illustrative embodiment of the stereo phase modulator 16 of this invention. The oscillator 14 operates at the carrier frequency fc to produce a waveform E1 taking the form of Cos Wct, which drives a voltage controlled phase shifter 40. The phase of its output signal is a function (preferably, but not necessarily, linear) of an applied control voltage E2 to produce a waveform E3 appearing as Cos (Wct+$\alpha$), where $\alpha$ has not yet been defined. The waveform E3 is applied to two synchronous phase detectors 42 and 44, a "C" detector 42 whose output waveform E4 is proportional to Cos $\alpha$, and an "S" detector 44 whose output waveform E5 is proportional to the Sin $\alpha$. These detector output waveforms E4 and E5 drive respectively two analog multipliers 46 and 48. The waveform E4 is multiplied by the Q or (L−R) signal from the matrix 12 and the waveform E5 is multiplied by the I or (1+L+R) signal from the matrix 12. The output E6 of the analog multiplier 46 appears as (L−R) Cos $\alpha$ and the output E7 of the analog multiplier 48 appears as (1+L+R) Sin $\alpha$.

The waveforms E6 and E7 are summed together by a high gain difference amplifier 50 to output the difference waveform E2, which is applied to the voltage controlled phase shifter 40, as noted above. This difference waveform E2 causes the phase shifter 40 to adjust the phase $\alpha$ so that waveform E6 equals the waveform E7. From the above, it is seen that the output waveform E2 of the difference amplifier 50 may be expressed as:

$$E2=A\ \{Q\ \mathrm{Cos}\ \alpha - I\ \sin\alpha\}, \tag{6}$$

where A is the voltage gain of the difference amplifier 50. Further, the previously undefined value of phase may be expressed as:

$$\alpha=E2\ Kp, \tag{7}$$

where Kp is a function representing (in radians/volt) the characteristics of the phase shift circuit 40. Combining and rearranging equations (6) and (7) gives:

$$\alpha/KpA=Q\ \mathrm{Cos}\ \alpha - I\ \sin\alpha \tag{8}$$

If A>>$\alpha$/KpA, the left hand side of equation (8), can be considered to be equal to zero, the waveform E4 is made equal to the waveform E6, which may be expressed by the following equation:

$$Q\ \mathrm{Cos}=I\ \mathrm{Sin} \tag{9}$$

Equation (9) can be manipulated to provide the expression:

$$\mathrm{Sin}\ \alpha/\mathrm{Cos}\ \alpha=\tan\alpha=Q/I \tag{10}$$

Inspection of equation (10) indicates that the previously undefined variable has been made the equivalent of $\phi$, as defined above, when the gain A of the difference amplifier 50 is set sufficiently high. Detailed analysis shows that for practical circuit components, the gain A may be set equal to 1000 to yield an acceptable phase error of less than 0.06 degrees.

The output E2 of the phase shifter 40 may now be expressed as Cos (Wct+$\phi$) and applied to the AM transmitter 18, as shown in FIG. 2, to be amplitude modulated by the component signal (L+R) as provided by the encoding matrix 12, whereby the output of the AM transmitter 18 corresponds to the fully compatible signal of equation (5) having the appropriate phase and envelope portions to be transmitted via the antenna 20 to the AM receiving system 30.

Figure 4:
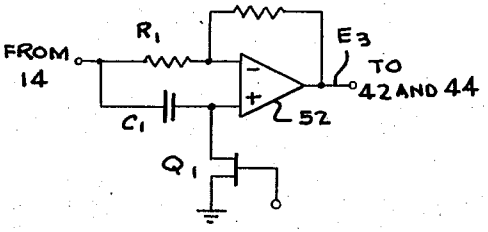
FIG. 4 is a detailed circuit diagram of a voltage control phase shifter as may be incorporated into the stereo phase modulator of FIG. 3.

The detailed circuitry within the blocks of FIG. 3 is well known to those skilled in this art. The voltage controlled phase shifter 40 may illustratively take the form of one or more stages of the circuitry shown in FIG. 4. Each such stage, as shown in FIG. 4, comprises an operational amplifier 52 having a first or negative input supplied through a resistor R1 and a second or positive input supplied through a capacitors C1. The positive input is tied to ground through a field effect transistor Q1. The output appears as waveform E3 and is fed back to the negative input via resistor R2. The "C" and "S" decoders 42 and 44 illustratively may be Motorola MC1496 integrated circuits. The switching voltages for these detectors 42 and 44 are derived from the oscillator 14. The analog multipliers 46 and 48 may illustratively be Analog Devices AD543. The difference amplifier 50 may be an ordinary operational amplifier taking the form in an illustrative embodiment of this invention as a MC 356 as made by Motorola.

Figure 5:
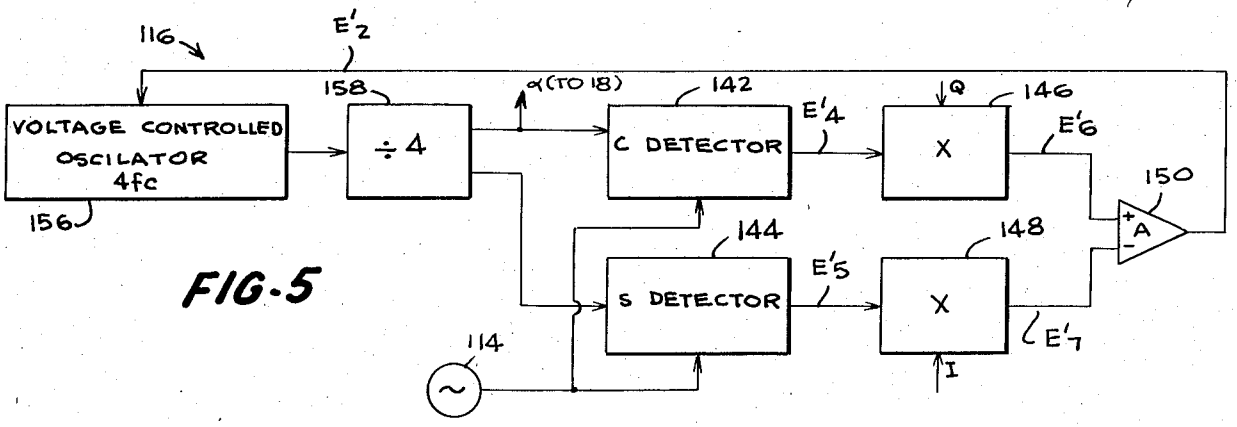
FIG. 5 is a functional block diagram of a further embodiment of the stereo phase modulator of FIG. 3.

FIG. 5 shows another embodiment of the phase modulator, where like elements are similarly numbered but in the 100 series. In this embodiment, a voltage controlled oscillator 156 is used to accomplish the required phase shift. It operates at four times the desired carrier frequency fc. Its output is divided by four with a divider 158 comprised illustratively of two D type flip flops (not shown) to produce two switching voltages, one 90° ahead of the other, for the C and S detectors 142 and 144. The Sine wave oscillator 114 operating at the carrier frequency fc supplies input signals for the detectors 142 and 144. The remainder of this circuit is identical to that of FIG. 3 and the above description of that circuit also applies.

Figures 1A, 1B, 1C:
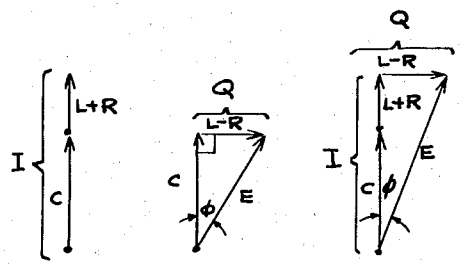
FIGS. 1A, 1B and 1C are respectively vector diagrams of the phase components of a modulating carrier signal showing respectively the (L+R) component signal for monaural program material, the (L−R) component signal as added in quadrature with the carrier signal, and the general case in which the left and right signals (L) and (R) have no special relationship to each other.

The phase modulator 116 of FIG. 5 is a complex phase lock loop. At rest (no modulation), the voltage controlled oscillator 156 is locked at exactly the carrier frequency fc as defined by the fc oscillator 114. This can be seen as follows: at rest $I=1$, $Q=\phi$, and $Q \cos \alpha=\phi$. If $\alpha$ is not zero, I sin $\alpha$ applied to the difference amplifier 150 generates a correction waveform $E'2=-AI \sin \alpha$. The output of the voltage controlled oscillator 156 is adjusted to reduce $\alpha$ toward zero. Thus, as in other phase lock loops, the circuit will reach an equilibrium condition such that $\alpha \approx \phi$. The error in $\alpha$ can be made negligible with a large value of the gain A of the difference amplifier 150. Therefore, the voltage controlled oscillator 156 is held at 4 fc and synchronous with the oscillator 114. When modulation is applied, the feedback waveform E'2 changes and attempts to change the frequency of the voltage controlled oscillator 156 but only succeeds in changing its phase such that $\alpha=\phi$ as described in the analysis of FIG. 1B.

There has been described a new and improved AM stereophonic transmission system that avoids the difficulties of the prior art as occur with the use of limiting circuits, or with the use of tuned circuits, which invariably limit bandwidth and require careful tuning. The AM stereophonic transmission system of this invention generates first and second multiplied signals Q Cos $\alpha$ and I Sin $\alpha$ at audio frequencies with readily available components. Further, the circuitry proposed by this invention is inherently capable of long term stability.

In considering this invention, it should be remembered that the present disclosure is illustrative only and the scope of the invention should be determined by the appended claims.

I claim as my invention:

1. Apparatus for transmitting in quadrature a single carrier signal carrying information corresponding to first and second signals including means supplying said first, second, and carrier signals, said apparatus further comprising:

(a) means for providing a third signal indicative of the difference of said first and second signals and a fourth signal indicative of the sum of said first and second signals;

(b) means responsive to a feedback signal for phase modulating said carrier signal in accordance with said feedback signal;

(c) feedback means for providing said feedback signal and comprising means for detecting a component of said phase modulated carrier signal in phase with said carrier signal to provide an in phase signal and detecting a gomponent of said phase modulated carrier signal out of phase with said carrier signal to provide a quadrature signal;

(d) means for multiplying respectively said in phase and quadrature signals by said third and fourth signals to provide first and second multiplied signals;

(e) means for obtaining the difference of said first and second multiplied signals to provide said feedback signal whereby said phase modulating means phase modulates said carrier signal in accordance with the ratio of said third signal to said fourth signal; and (f) means for amplitude modulating said phase modulated carrier signal in accordance with said third signal, said transmitted carrier signal being fully compatible for reception and reproduction of said third signal with substantially no distortion.

2. Apparatus for transmitting a signal in the form of $(L+R) \cos (2\pi fc+\phi)$, where (L) is indicative of a first signal and (R) is indicative of a second signal, said transmitting apparatus comprising:

(a) means for generating a carrier signal of frequency fc;

(b) means responsive to a feedback signal for phase modulating said carrier signal with a phase angle $\alpha$; and (c) feedback means responsive to said phase modulated carrier signal for providing said feedback signal and comprising means for detecting a component of said phase modulated carrier signal in phase with said carrier signal to provide a first detected signal proportional to Cos $\alpha$ and a component of said phase modulated carrier signal out of phase with said carrier signal to provide a second detected signal proportional to Sin $\alpha$, means for multiplying respectively said first and second detected signals by $(L-R)$ and $(1+L+R)$ to provide a first multiplied signal proportional to $(L-R)$ Cos $\alpha$ and a second multiplied signal proportional to $(1+L+R)$ Sin $\alpha$, means for obtaining the difference of said first and second multiplied signals to provide said feedback signal according to the difference therebetween, whereby $\alpha$ is set substantially equal to $\phi$, where $\phi$ is defined as $$\mathrm{Tan}^{-1}\frac{(L-R)}{(1+L+R)};$$

and (d) means for amplitude modulating said phase modulated carrier signal with (L+R) to provide said transmitted signal in the form of (1+L+R) Cos ($2\pi fc+\phi$).

3. The transmitting apparatus as claimed in claim 2, wherein said difference means has a gain set sufficiently high so that (L−R) Cos $\alpha \approx$ (1+L+R) Sin $\alpha$ and $\alpha \approx \phi$.

4. The transmitting apparatus as claimed in claim 3, wherein said gain is set not less than 1000.

5. The transmitting apparatus as claimed in claim 2, wherein there is further included matrix means responsive to said first signal (L) and said signal (R) to provide (1+L+R) and (L−R).

6. The transmitting apparatus as claimed in claim 5, wherein said multiplying means is coupled to said matrix means for receiving (L−R) and (1+L+R) therefrom and multiplying said first and second detected signals by (L−R) and (1+L+R) to provide respectively said first and second multiplied signals.

7. The transmitting apparatus as claimed in claim 2, wherein said phase modulating means is coupled to said carrier signal generating means, whereby said modulating means is locked in synchronism with said carrier signal.

8. The transmitting apparatus as claimed in claim 7, wherein said phase modulating means comprises a voltage controlled oscillator coupled to said carrier signal generating means for outputing a first phase modulated signal in synchronism with said carrier signal and a second phase modulated signal 90° out of phase with said carrier signal, said detecting means responsive to said carrier signal and said first modulated signal for providing said first detected signal and responsive to said carrier signal and said second phase modulated signal to provide said second detected signal.

* * * * *